US010158176B2

(12) United States Patent
Lin et al.

(10) Patent No.: US 10,158,176 B2
(45) Date of Patent: Dec. 18, 2018

(54) PATCH ANTENNA HAVING PROGRAMMABLE FREQUENCY AND POLARIZATION

(71) Applicants: JIANGSU HENGXIN TECHONOLOGY LIMITED CORPORATION, Dingshu Yixing, Jiangsu (CN); UNIVERSITY OF ELECTRONIC SCIENCE AND TECHNOLOGY OF CHINA, Chengdu, Sichuan (CN)

(72) Inventors: Xianqi Lin, Sichuan (CN); Jin Zhang, Sichuan (CN); Yuan Jiang, Sichuan (CN); Jiawei Yu, Sichuan (CN); Zhanyu Kang, Sichuan (CN); Peng Mei, Sichuan (CN); Zhonghua Liu, Jiangsu (CN); Yanping Hua, Jiangsu (CN)

(73) Assignee: JIANGSU HENGXIN TECHNOLOGY LIMITED CORPORATION (CN)

( * ) Notice: Subject to any disclaimer, the term of this patent is extended or adjusted under 35 U.S.C. 154(b) by 57 days.

(21) Appl. No.: 15/310,402

(22) PCT Filed: May 5, 2015

(86) PCT No.: PCT/CN2015/000309
§ 371 (c)(1),
(2) Date: Nov. 10, 2016

(87) PCT Pub. No.: WO2016/165042
PCT Pub. Date: Oct. 20, 2016

(65) Prior Publication Data

US 2017/0271770 A1 Sep. 21, 2017

(30) Foreign Application Priority Data

Apr. 16, 2015 (CN) ..... 2015 1 0182499

(51) Int. Cl.
*H01Q 9/04* (2006.01)
*H01Q 9/42* (2006.01)

(52) U.S. Cl.
CPC ..... *H01Q 9/0442* (2013.01); *H01Q 9/0428* (2013.01); *H01Q 9/0492* (2013.01); *H01Q 9/42* (2013.01)

(58) Field of Classification Search
CPC .. H01Q 9/0407; H01Q 9/0442; H01Q 9/0492; H01Q 9/42
See application file for complete search history.

(56) References Cited

U.S. PATENT DOCUMENTS 4,197,544 A * 4/1980 Kaloi ..... H01Q 1/48 343/700 MS
7,079,079 B2 * 7/2006 Jo ..... H01Q 1/243 343/700 MS
8,659,498 B2 * 2/2014 Rothwell ..... H01Q 9/0442 343/700 MS

* cited by examiner

*Primary Examiner* — Dameon E Levi
*Assistant Examiner* — Hasan Islam

(57) ABSTRACT

The present invention relates to a patch antenna having programmable frequency and polarization comprising the first metal covering layer, the dielectric layer, the second metal covering layer and four metallized through-holes, each of which are disposed sequentially from top to bottom, wherein the first metal covering layer comprises the feeding line and the radiating patch; the feeding line comprises the micro-strip line, which can be connected to the outer feeding port; the micro-strip line is connected to one side of the radiating patch through the high-resistance line; the radiating patch is a square-shaped metal patch; a gap is etched near the other side of the radiating patch, namely, the radiating edge; the gap is parallel to the radiating edge.

8 Claims, 2 Drawing Sheets

PATCH ANTENNA HAVING PROGRAMMABLE FREQUENCY AND POLARIZATION

TECHNICAL FIELD OF THE INVENTION

The present invention relates to the field of antenna technology, and more particularly, to a patch antenna having programmable frequency and polarization.

BACKGROUND OF THE INVENTION

With the rapid development of wireless communication systems, the antenna, as a critical component of the system, is required to satisfy a dynamic environment and smaller design space. Therefore, a different design is required to improve the informational capacity and environmental durability of the antenna. The programmable antenna is one potential method of the reconfigurable antenna. The first is to design various working modes on an individual antenna as much as possible, and the second is to choose a working mode through one or more switches. The flexibility of switching among a plurality of working modes can be realized through the programming control of the on-off state. Compared with the conventional reconfigurable antenna, the programmable antenna can realize more working modes, and one working mode can be switched to another in a flexible manner.

Programming technology has long been applied in microwave devices, including amplifiers with programmable transmission gain, an oscillating source with programmable frequency, a programmable filter and programmable digital phase shifter, etc. However, programming technology has not been widely used in the field of antennas. The reconfigurable design of the antenna normally adopts two methods: the reconfiguration of the feeding network and the reconfiguration of the antenna structure. By altering the feeding phase in a different port, the antenna can function under different polarization characteristics so that the reconfiguration of the feeding network can be achieved. However, simultaneously reconfiguring the working frequency of the antenna is difficult because the working frequency of the antenna is mainly determined by the resonance length of the structure. Although the structural reconfiguration of the antenna can alter the working frequency and polarization, the consequent damage to the structure can cause deterioration of performance and the interference between different working modes that cannot be avoided, resulting in limited choices of working modes, which can be realized by this method. In the prior art, the conventional programmable antenna adopts either the array antenna to control an individual unit or the reflective array antenna to control the phase of the reflector programmatically. Nevertheless, both of the two methods have disadvantages of having a big size, complicated feeding way, and use of a large amount of switches. Thus, the present invention aims to provide a reconfigurable patch antenna, having the advantages of a simple structure, various working modes and easy control.

SUMMARY OF THE INVENTION

The purpose of the present invention is to provide a patch antenna having programmable frequency and polarization, which can solve the disadvantages of the prior art, including having a big size, complicated feeding network and limited working modes in the prior art.

To achieve the above purpose, the present invention adopts the following technical solution:

A patch antenna having programmable frequency and polarization, comprising a first metal covering layer, a dielectric layer, a second metal covering layer, a first metallized through-hole, a second metallized through-hole, a third metallized through-hole and a fourth metallized through-hole, each of which are disposed sequentially from top to bottom.

The first metal covering layer comprises the feeding line and the radiating patch. The feeding line comprises the micro-strip line, which can be connected to the outer feeding port. The micro-strip line is connected to one side of the radiating patch through the high-resistance line. The radiating patch is a square-shaped metal patch. A gap is etched near the other side of the radiating patch, namely, the radiating edge. The gap is parallel to the radiating edge.

The first metallized through-hole, the second metallized through-hole, the third metallized through-hole and the fourth metallized through-hole are disposed at the two sides of the bended part of the gap. The two ends of the metallized through-holes are respectively connected to the first metal covering layer and the second metal covering layer. The first metallized through-hole, the second metallized through-hole, the third metallized through-hole and the fourth metallized through-hole are provided with switches respectively. When a switch is switched on, the first metal cover layer is connected to the second metal covering layer through the metallized through-hole controlled by this switch.

Further, the middle part of the gap is U-shaped, which is connected end-to-end; the U-shaped edge is perpendicular to the radiating edge.

Further, the dielectric layer and the second metal covering layer are the same size and square-shaped, of which the area is larger than that of the first metal covering layer.

Further, the switch is a PIN diode switch, MEMS switch or mechanical metal-connecting switch.

Compared with the prior art, the present invention provides a programmable patch antenna having a simple feeding network, small size and various working modes.

MARKING INSTRUCTIONS OF THE DRAWINGS

1. The First Metal Covering Layer, 2. The Dielectric Layer, 3. The Second Metal Covering Layer, 41. The First Metallized Through-hole, 42. The Second Metallized Through-hole, 43. The Third Metallized Through-hole, 44. The Fourth Metallized Through-hole, 5. Micro-strip Line, 6. High-resistance Line, 7. Gap

DETAILED DESCRIPTION OF THE INVENTION

Drawings and detailed embodiments are combined hereinafter to elaborate the technical principles of the present invention.

Figure 1:
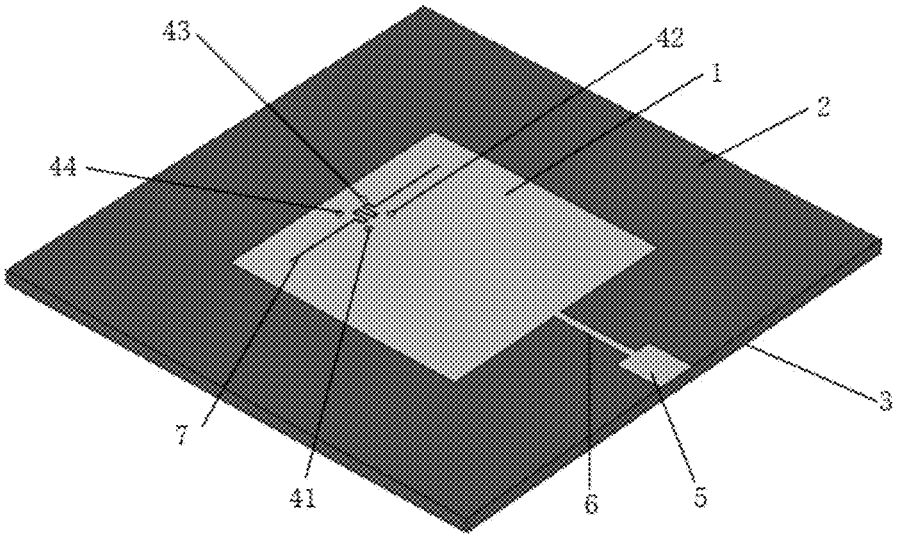
FIG. 1 is a structure diagram of the antenna having programmable frequency and polarization of the present invention.

As shown in FIG. 1, the patch antenna having programmable frequency and polarization comprises the first metal covering layer 1, the dielectric layer 2, the second metal covering layer 3, the first metallized through-hole 41, the second metallized through-hole 42, the third metallized through-hole 43 and the fourth metallized through-hole 44, each which are disposed sequentially from top to bottom. The first metal covering layer 1 comprises the feeding line and the radiating patch. The feeding line comprises the 50Ω micro-strip line 5, which can be connected to the outer feeding port. The micro-strip line 5 is connected to one side of the radiating patch through the high-resistance line 6. The radiating patch is a square-shaped metal patch. A gap 7 is etched near the other side of the radiating patch, namely, the radiating edge. The gap 7 is parallel to the radiating edge; the middle part of the gap is U-shaped, which is connected end-to-end. The U-shaped edge is perpendicular to the radiating edge. The first metallized through-hole 41, the second metallized through-hole 42, the third metallized through-hole 43 and the fourth metallized through-hole 44 are disposed at the two sides of the bended part of the gap 7. The two ends of the metallized through-holes are respectively connected to the first metal covering layer 1 and the second metal covering layer 3. The first metallized through-hole 41, the second metallized through-hole 42, the third metallized through-hole 43 and the fourth metallized through-hole 44 are provided with switches respectively. When a switch is turned on, the first metal cover layer 1 is connected to the second metal covering layer 3 through the metallized through-hole controlled by this switch. The switch is preferred to be a PIN diode switch. The dielectric layer 2 and the second metal covering layer 3 are square-shaped and the same size, of which the area is bigger than that of the first metal covering layer 1. Additionally, the length and width of the high-resistance line 6 can be regulated.

The principle of the technical solution of the present invention is to regulate the length and the width of the above high-resistance line 6 so as to match the different input resistance. Meanwhile, the loading switch can improve the resistance matching, producing optimal high frequency synchronization and improving the mismatching of the low frequency by the switch. The location of the above bended gap 7 is near the radiating edge of the patch. For $TM_{100}$ mode, the radiating edge of the patch is zero current so that the gap 7 has a small interference on the current. With respect to the $TM_{200}$ mode, the current of the location of the gap 7 is higher and the location of the gap 7 is perpendicular to the direction of the resonance current, resulting in a large amount of interference on the current. When the length and location of the gap 7 are proper, one of the half-wavelength resonance areas can be reduced. Meanwhile, when the current moves around the gap 7, the far-field radiation generated by the device can be counteracted. The two wave beams of $TM_{200}$ mode and the zero point in the middle can disappear and change into a wave beam similar to the $TM_{100}$ mode. When the patch around the gap 7 is regarded as two U-shaped branches which are jointed together, the current can be regarded as the resonance on one branch under $TM_{200}$ mode. For $TM_{100}$ mode, this area can also be regarded as a U-shaped branch without resonance. The current path on the U-shaped branch is lengthened by the bended part in the middle of the gap, slightly reducing the working frequency.

With respect to the $TM_{100}$ mode, when the switches $S_1$, $S_3$ and $S_4$ are switched off and switch $S_2$ is switched on, one end of the right branch near the interior of the patch is grounded through the switch, which is equivalent to load inductance on the end of the branch, thereby changing the phase of the surface current and forming the circular polarization. For the $TM_{200}$ mode, the switch is equivalent to the inductive grounding. In this case, the inductance is a negative inductance, which is affected by the resonance current of the bottom half of the patch. Accordingly, the length of resonance is shortened. Compared with the condition that four switches are switched-off simultaneously, the high frequency moves upwards a little at the moment. When the switch $S_2$, which is switched on, is replaced by Switch $S_1$, the low frequency is changed from right-handed circular polarization to left-handed circular polarization. When switch $S_1$, $S_2$ are switched on and switch $S_3$ $S_4$ are switched off, for low frequency, the inductance is loaded on the left and right U-shaped branches symmetrically so that the phase difference of the surface current can be eliminated accordingly, producing the dual-frequency linear polarization working mode. Additionally, the mismatched low-frequency input resistance can be compensated and the low frequency synchronization can be improved without compromising high frequency functionality. When at least one of switch $S_3$ or $S_4$ is switched on, the $TM_{100}$ mode is mismatched badly, leaving one working frequency of $TM_{200}$ mode. However, for a different combination of switches, the working frequency can be different due to the different presentation of loading inductance. Therefore, frequency regulation can be produced by regulating the state of the switch. The working frequency is the resonance frequency of $TM_{200}$ mode so that the linear polarization working state can be realized.

Figure 2:
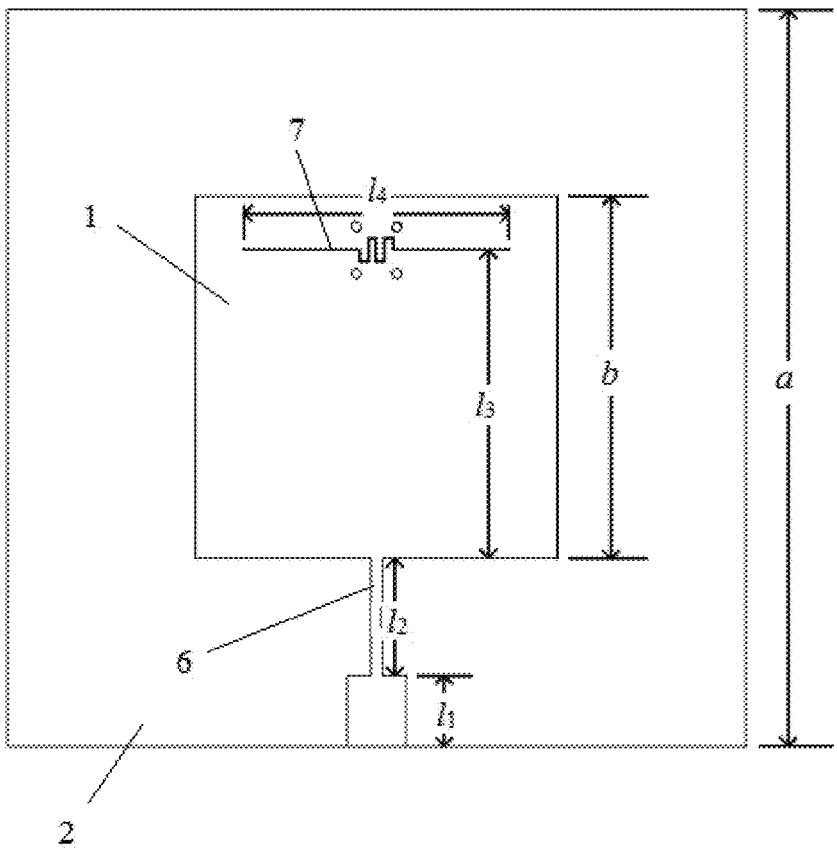
FIG. 2 is a structure diagram of the first metal covering layer of the embodiment of the present invention.
Figure 3:
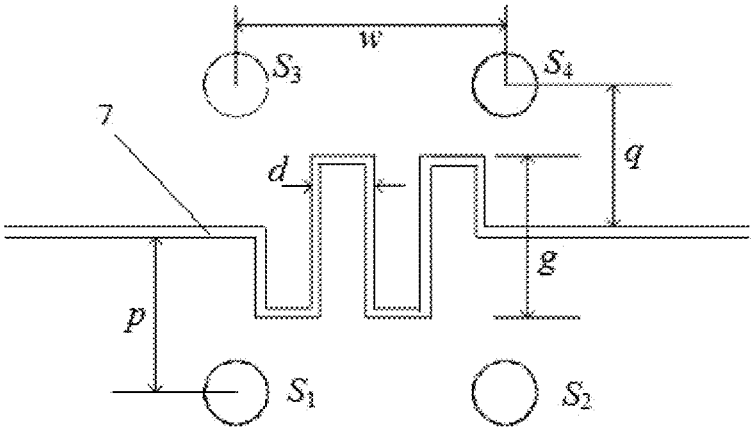
FIG. 3 is a schematic diagram of the gap and the switch of the embodiment.

To further elaborate the practicality of the above technical solution, a detailed design is provided hereinafter. As shown in FIGS. 2 and 3, the dielectric substrate of the patch antenna having programmable frequency and polarization adopts a F4B substrate, of which the thickness is 2 mm and the dielectric constant is 2.55. The geometric parameter values of the corresponding antenna are: a=75 mm, b=36.8 mm, 11=6.9 mm, 12=12 mm, 13=31.4 mm, 14=26 mm, g=2.5 mm, p=2.4 mm, w=3.34 mm, d=1 mm, q=2.35 mm. The testing result shows that the working frequency of the antenna under the dual-frequency linear polarization working mode is 2.47 GHz and 4 GHz respectively. Additionally, the working frequency under the right-handed circular polarization-linear polarization working mode is 2.45 GHz and 3.89 GHz respectively, in which the axial ratio of 2.45 GHz is 0.86 dB. The working frequency of the antenna under the single-frequency working mode is shown in Table 1. In this arrangement, "1" and "0" means the switch is turned on and off respectively according to the coding rule of the working module. For instance, when switch $S_2$ and $S_4$ are switched on, the code of $S_1S_2S_3S_4$ is "0101". The cross-polarization of the antenna under all of the frequencies is less than −15 dB.

TABLE 1

| Working mode | Frequency (GHz) | Working mode | Frequency (GHz) | Working Mode | Frequency (GHz) |
|---|---|---|---|---|---|
| 0100 | 2.865 | 0101 | 3.021 | 0110 | 3 |
| 0111 | 3.06 | 1000 | 2.868 | 1001 | 2.868 |
| 1010 | 3.021 | 1011 | 3.06 | 1100 | 2.973 |
| 1101 | 3.141 | 1110 | 3.141 | 1111 | 3.198 |

The present invention also has the following advantages:

(1) The working modes of the present invention are various, having linear polarization, left-handed circular polarization and right handed circular polarization under the dual-frequency working mode and nine different working frequencies under the single-frequency working mode;

(2) The control is easy, requiring only four PIN diode switches;

(3) The damage to the antenna's structure minimal, assuring optimal performance of the antenna in every working mode.

The previous descriptions are of preferred examples for implementing the invention, and the scope of the invention should not necessarily be limited by this description. The scope of the present invention is defined by the claims.

The invention claimed is:

1. A patch antenna having programmable frequency and polarization comprising:

a first metal covering layer;

a dielectric layer;

a second metal covering layer;

a first metallized through-hole;

a second metallized through-hole;

a third metallized through-hole, and a fourth metallized through-hole, wherein the first metallized through-hole, second metallized through-hole, third metallized through-hole, and fourth metallized through-hole are disposed sequentially from top to bottom, wherein the first metal covering layer comprises a feeding line and a radiating patch, wherein the feeding line comprises a 50Ω micro-strip line, which can be connected to an outer feeding port, wherein the micro-strip line is connected to one side of the radiating patch through a high-resistance line, wherein the radiating patch is a square-shaped metal patch, wherein a gap is etched near an edge of the radiating patch, wherein the gap is parallel to the edge which is a radiating edge, wherein the first metallized through-hole, the second metallized through-hole, the third metallized through-hole and the fourth metallized through-hole are disposed at both sides of the a bended part of the gap, wherein both ends of the four metallized through-holes are respectively connected to the first metal covering layer and the second metal covering layer, wherein the first metallized through-hole, the second metallized through-hole, the third metallized through-hole and the fourth metallized through-hole are provided with switches respectively, wherein when a switch is switched on, the first metal cover layer is connected to the second metal covering layer through the metallized through-hole controlled by this switch, wherein the middle part of the gap is U-shaped, which is connected end-to-end, and the U-shaped gap is perpendicular to the radiating edge.

2. The patch antenna having programmable frequency and polarization of claim 1, wherein the dielectric layer and the second metal covering layer have the same size and are square-shaped, wherein the area of the second metal covering layer is bigger than that of the first metal covering layer.

3. The patch antenna having programmable frequency and polarization of claim 1, wherein the switch is a PIN diode switch, MEMS switch or mechanical metal-connecting switch.

4. The patch antenna having programmable frequency and polarization of claim 1, wherein the gap comprises two U-shaped branches which are joined together.

5. The patch antenna having programmable frequency and polarization of claim 1, wherein the dielectric substrate comprises a F4B substrate, wherein the F4B substrate has a thickness of 2 mm and the dielectric constant is 2.55.

6. The patch antenna having programmable frequency and polarization of claim 1, wherein the geometric parameter values of the antenna are a=75 mm, b=36.8 mm, 11=6.9 mm, 12=12 mm, 13=31.4 mm, 14=26 mm, g=2.5 mm, p=2.4 mm, w=3.34 mm, d=1 mm, q=2.35 mm.

7. The patch antenna having programmable frequency and polarization of claim 1, wherein the working frequency of the antenna under a dual-frequency linear polarization is 2.47 GHz and 4 GHz respectively.

8. The patch antenna having programmable frequency and polarization of claim 1, wherein the antenna has a linear polarization, left-handed circular polarization and right handed circular polarization under a dual-frequency mode and nine different frequencies under a single-frequency mode.

* * * * *